US005516380A

United States Patent [19]

Darolia et al.

[11] Patent Number: 5,516,380

[45] Date of Patent: May 14, 1996

[54] NIAL INTERMETALLIC ALLOY AND ARTICLE WITH IMPROVED HIGH TEMPERATURE STRENGTH

[75] Inventors: Ramgopal Darolia, West Chester, Ohio; James R. Dobbs, Niskayuna, N.Y.; Robert D. Field, Los Alamos, N.M.; Edward H. Goldman, Cincinnati, Ohio; David F. Lahrman, Powell, Ohio; William S. Walston, Maineville, Ohio

[73] Assignee: General Electric Company, Cincinnati, Ohio

[21] Appl. No.: 324,037

[22] Filed: Oct. 14, 1994

[51] Int. Cl.[6] ..... C22C 19/03

[52] U.S. Cl. ..... 148/404; 148/409; 148/429; 415/200; 416/241 R

[58] Field of Search ..... 148/404, 409, 148/429; 420/445, 460, 550; 428/608; 415/200 R; 416/241 R

[56] References Cited

U.S. PATENT DOCUMENTS

| | | | |
|---|---|---|---|
| 2,910,356 | 10/1959 | Grala et al. | 420/460 |
| 5,116,438 | 5/1992 | Darolia et al. | 148/404 |
| 5,116,691 | 5/1992 | Darolia et al. | 148/404 |
| 5,167,732 | 12/1992 | Naik | 148/404 |
| 5,215,831 | 6/1993 | Darolia et al. | 428/614 |

OTHER PUBLICATIONS

CAbs. 120:141287 1994.

J of the Korean Inst. of Met. & Mater V 31, No. 6 (1993) 810–817.

*Primary Examiner*—David A. Simmons
*Assistant Examiner*—Margery S. Phipps
*Attorney, Agent, or Firm*—Andrew C. Hess; David L. Narciso

[57] ABSTRACT

A NiAl intermetallic alloy and article is provided with improved high temperature strength, particularly stress rupture strength, through the generation of a multiphase microstructure comprising a beta matrix and at least one precipitate phase. The strength properties and microstructure are the result of alloying with at least two elements selected from Ga, Hf, and optionally Ti, Zr, Ta, Nb, and V, in defined ranges. Preferred are at least two of the elements Ga, Hf, and Ti, and specifically preferred are all three. A specifically preferred form of the invention, in atomic percent, is about 45–59% Ni, about 0.02–0.5% Ga, about 0.2 to less than 1% Hf, about 0.1–10% Ti, with the balance Al and incidental impurities.

9 Claims, 3 Drawing Sheets

NIAL INTERMETALLIC ALLOY AND ARTICLE WITH IMPROVED HIGH TEMPERATURE STRENGTH

The Government has rights in this invention pursuant to Contract No. F33615-90-C-2006 awarded by the Department of the Air Force.

FIELD OF THE INVENTION

This invention relates to NiAl intermetallic alloys, and more particularly, to such intermetallics having improved high temperature strength.

BACKGROUND OF THE INVENTION

With the advance of the gas turbine engine technology, there has been recognized a need for lightweight materials which can resist deterioration at high temperatures and have sufficient mechanical properties to withstand strenuous operating conditions. The metallurgical art has described a wide variety of superalloys developed for that purpose. Frequently, such superalloys are based on nickel and preferably are in the form of single crystal articles for such gas turbine components as turbine airfoils. Also, effort has been directed to the development of high temperature alloys based on cobalt or iron.

Intermetallics of Ni and Al have been the subject of investigations as replacements for the superalloys currently used in gas turbine engines. Many such investigations have been directed to improvements and refinements in $Ni_3Al$. More recently, however, interest has been exhibited in connection with intermetallic compounds such as those based on the NiAl system because of their relative lower density along with the potential to be used at high temperatures, for example, as a turbine airfoil. Compared with nickel base superalloys, their density can be up to about 33% lower, and their thermal conductivity can be up to about 300% higher. However, the low ductility of binary NiAl intermetallics, less than 1% between room temperature and about 600° F., had impeded the implementation of NiAl intermetallics as a viable substitute for nickel base superalloys. More recent efforts to improve ductility in such compounds are described in U.S. Pat. Nos. 5,116,438; 5,116,691; and 5,215,831—Darolia et al, assigned to the assignee of the present invention. Those patents include extensive background and description of efforts in connection with the NiAl intermetallic system and their disclosures are hereby incorporated herein by reference to be a part of this background presentation. Of particular interest to the preferred form of the present invention is the U.S. Pat. No. 5,116,438 describing the microalloying of the NiAl system with gallium to significantly improve the low temperature ductility of the system. Resulting from such alloying is a microstructure characterized by a more ductile single phase matrix. Reference to the phase diagram for the NiAl intermetallic shows that from about 45 at % to about 59 at % Ni with the balance Al, that intermetallic exists as a single beta phase. That phase exists up to its melting point in the range of about 2950°–3000° F.

Such an intermetallic alloy can be useful for selected applications not requiring the high temperature strength needed in hot turbine engine components. However, those alloys do not possess adequate high temperature strength to be competitive with the more advanced nickel base superalloys. Nevertheless, the NiAl system is very attractive for use as turbine blading members because their lower density, and associated weight reduction, and their higher thermal conductivity, and associated more effective cooling of the component, can result in more efficient engine operation. The stresses in NiAl intermetallic alloy airfoils can be significantly lower than in superalloy blades under the same operating conditions. Therefore, development of a NiAl intermetallic alloy with improved high temperature mechanical strength properties, along with good low temperature ductility to enable manufacture and initiation of operation, is highly desirable.

SUMMARY OF THE INVENTION

The present invention, in one form, provides a beta phase type NiAl intermetallic alloy, and article made therefrom, particularly as a single crystal, having a microstructure including a single phase beta matrix and at least one or more precipitate phases which provide the alloy with improved high temperature strength properties, particularly stress rupture strength with a life of at least about 25 hours when tested at about 1600° F. under a stress of about 35 ksi. One form of the alloy comprises, in atomic percent, about 45–59% Ni, 0.1–10% of at least two elements selected from Ga, Ti and Hf, optionally up to 1% Zr, up to 5% Ta, up to 5% Nb, and up to 5% V with the balance Al and incidental impurities which do not adversely affect the advantageous aspects of the alloy. In a more particular form, the alloy of the present invention includes at least one of the elements Ti and Hf, their combination with Ga, or in combination with each other, synergistically contributing to the formation of the strengthening precipitate phase or phases. When included, the Ga is in the range of about 0.02–0.5 atomic %, the Ti is in the range of about 0.1–10 atomic % and the Hf is in the range of about 0.2 to less than 1 atomic %.

DESCRIPTION OF THE PREFERRED EMBODIMENTS

Figure 1:
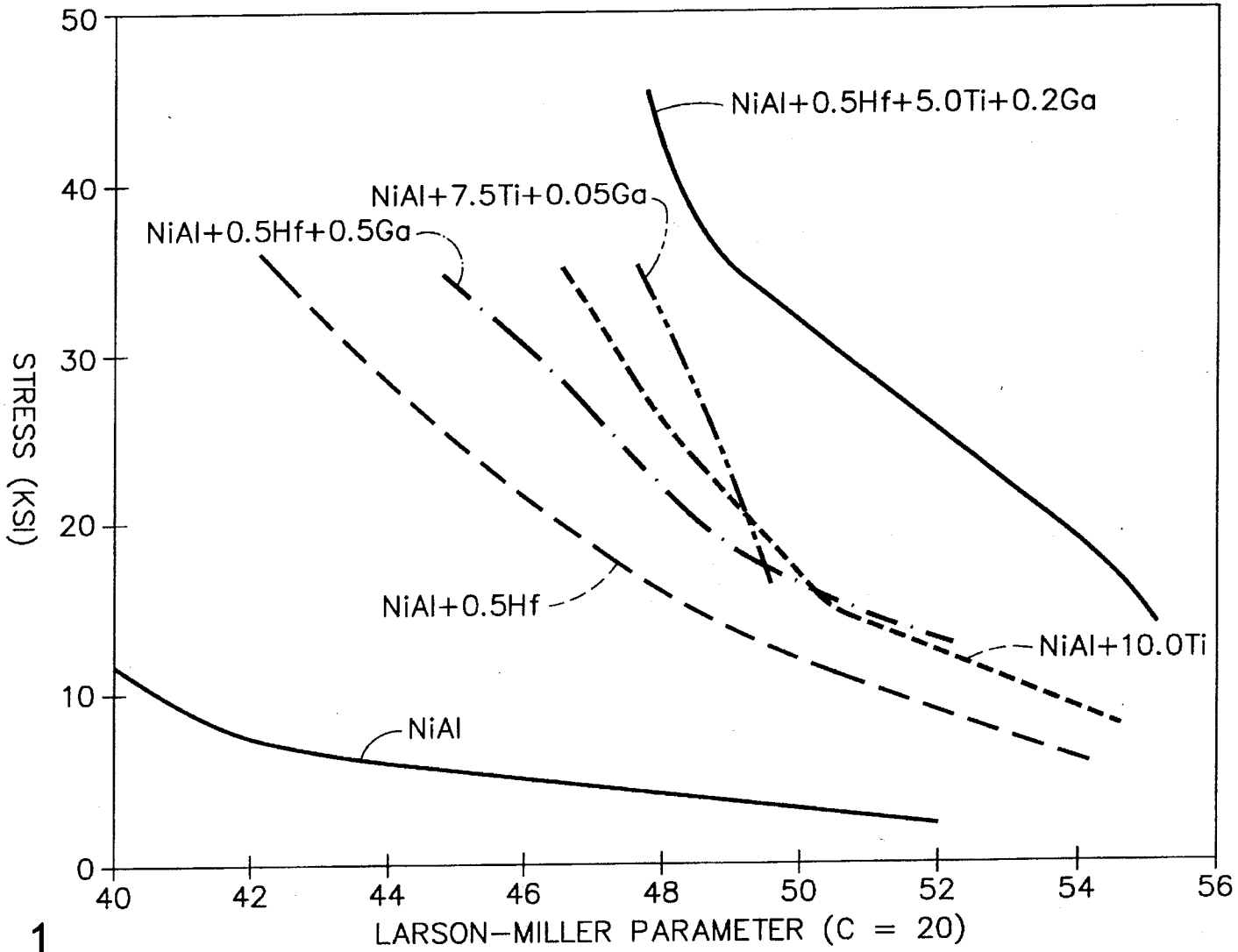
FIG. 1 is a graphical comparison of the stress rupture lives of forms of the NiAl system, including the present invention, using the Larson-Miller parameter.

The low temperature ductility of the NiAl intermetallic has been improved particularly by the microalloying with Ga, with Fe, and with combinations of Mo, Ga, Y, and/or Cr. To be competitive with current nickel base superalloys developed for single crystal articles, significantly improved high temperature strength properties are needed.

It has been reported that such strength can be improved by solid solution strengthening, for example with Co, Fe or Ti, and with the single element addition of certain group IV and V—B elements such as Ti, Hf, Zr, V or Ta. Also, addition of certain of such elements beyond their solubility limits in NiAl can produce precipitates of several ternary intermetallics which can contribute to the strengthening of the NiAl alloys. However, the resulting alloy can be embrittled to one degree or another depending on the type of phase precipitated: laves phase, (NiAlX), is more embrittling than is β' phase, ($Ni_2AlX$), where X is at least one of Ti, Hf, Zr, Ta, Nb, and V, and is more difficult to machine into test specimens. Generally all of these alloys include an impurity or contamination level of Si from mold materials during casting of specimens or articles, resulting in the precipitation of a phase or phases based at least partially on Si and which can contribute to strengthening of the alloy.

It has been found, according to the present invention, that the provision, in the beta matrix of the NiAl system, of at least one precipitate phase resulting from the addition of at least two elements selected from Ga, Ti, and Hf, in the range of about 0.1–10 atomic % optionally, in atomic %, up to 1% Zr, up to 5% Ta, up to 5% Nb, and up to 5% V synergistically results in significantly improved stress rupture properties. When selected, the Ga is about 0.02–0.5%, the Hf is about 0.2 to less than 1%, the Ti is about 0.1–10%, the Zr is about 0.1–1%, the Ta is about 0.1–5%, the Nb is about 0.1–5%, and the V is about 0.1–5%. In a preferred form of the invention, it has been recognized that the combination of at least two of Ga, Ti, and Hf, and specifically preferably all three, can develop at least one precipitate phase in the beta matrix that provides stress rupture strength competitive with the more advanced nickel base superalloys in their form as single crystals. According to that specific form of the invention, the ranges, in atomic %, are about 0.02–0.5% Ga, about 0.25–10% Ti, and about 0.2 to less than 1% Hf.

During evaluation of the present invention a wide variety of alloys based on the NiAl system were prepared. The following Table I lists selected of their compositions:

TABLE I

| | Composition (atomic %) | | |
|---|---|---|---|
| Alloy | Ga | Hf | Ti |
| D117 | | 0.5 | |
| D211 | | 0.75 | |
| D175 | 0.05 | 2.0 | |
| D176 | 0.05 | 0.5 | |
| AFS19 | 0.2 | 0.5 | |
| D113 | | | 7.5 |
| D178 | 0.05 | | 7.5 |
| D216 | 0.2 | | 7.5 |
| D217 | 0.2 | | 5.0 |
| D218 | 0.2 | 0.5 | 1.0 |
| D219 | 0.2 | 0.5 | 5.0 |
| AFN1 | 0.5 | 0.5 | |
| AFN2 | 0.2 | 0.75 | |
| AFN6 | 0.2 | 0.5 | 3.0 |
| AFN12 | 0.05 | 0.5 | 1.0 |
| AFN13 | 0.2 | 0.5 | 0.75 |
| AFN14 | 0.2 | 0.25 | 1.0 |
| AFN15 | 0.2 | 0.75 | 0.75 |
| AFN17 | 0.2 | 0.5 | 4.0 |
| AFN18 | 0.2 | 0.5 | 4.5 |
| AFN20 | 0.05 | 0.5 | 5.0 |

In the above Table I, Ni is included at about 50 atomic % except for alloy D113 which included about 52 atomic % Ni. The balance of the composition was Al and incidental impurities. The term "balance essentially Al and incidental impurities", as used herein, includes in addition to aluminum in the balance of the alloy small amounts of impurities and incidental elements which in character and/or amount do not adversely affect the advantageous aspects of the alloy. In the evaluation of the present invention impurities were maintained at low levels, measured in parts per million ("ppm"), so that their presence may be characterized as trace. These trace elements generally were interstitial elements such as oxygen, nitrogen, carbon, sulfur, and boron, and were present in mounts of less than 100 ppm by weight of each impurity. Certain alloy specimens evaluated were cast into the single crystal form in molds including silicon. Therefore, silicon can be present in amounts up to about 1000 ppm and can be involved in the generation in the beta matrix of one or more precipitate phases based at least partially on Si. For example, such phases can be $Ni_{16}X_6Si_7$, sometimes called G phase and/or NiXSi, where X can be at least one of Ti, Hf, Zr, Ta, Nb and V. The intermetallic alloy article of the present invention can be made by any suitable single crystal growth method that does not result in inclusion in the alloy of excessive impurities which would adversely affect mechanical properties.

Certain NiAl intermetallic alloys listed in Table I and others identified in Tables II and III below were prepared as single crystal specimens by the well known Bridgman withdrawal process in various crystal orientations including <110> and <100> directions. The following Table II presents the average stress rupture fives of certain NiAl intermetallic alloys compared with each other and with alloy D5 which was the 50 atomic % Ni, balance Al and incidental impurities. The data of Table II summarize testing conducted at 1600° F. under a stress of 35 thousand pounds per square inch ("ksi"), except where indicated otherwise, on single crystal specimens in the <110> crystal direction.

TABLE II

Average Stress Rupture Lives of NiAl Alloys (in hours)

| Alloy | Addition to NiAl (atomic %) | 1600° F./35 ksi (hours) |
|---|---|---|
| D5 | — | 2.2 @ 7.5 ksi |
| D117 | 0.5 Hf | 4.5 |
| D211 | 0.75 Hf | 113.4 |
| D209 | 1.0 Hf | F.O.L. |
| D145 | 1.5 Hf | 37.8 |
| D118 | 2.0 Hf | 21.6 |
| D146 | 2.5 Hf | 21.0 |
| D147 | 3.0 Hf | 28.6 |
| D111 | 2.5 Ti | 0.7 @ 25 ksi |
| D113 | 7.5 Ti | F.O.L. |
| D114 | 10.0 Ti | 390.8 |
| D144 | 12.5 Ti | F.O.L. |
| D176 | 0.5 Hf + 0.05 Ga | 68.6 |
| AFS19 | 0.5 Hf + 0.2 Ga | 40.7 |
| AFN1 | 0.5 Hf + 0.5 Ga | 32.4 |
| AFN2 | 0.75 Hf + 0.2 Ga | 60.9 |
| D217 | 5.0 Ti + 0.2 Ga | 1764.9+ |
| D178 | 7.5 Ti + 0.05 Ga | 1311.1 |
| D216 | 7.5 Ti + 0.2 Ga | 1207.7 |
| AFN12 | 0.5 Hf + 1 Ti + 0.05 Ga | 325 @ 45 ksi |
| AFN20 | 0.5 Hf + 5 Ti + 0.05 Ga | 1785 @ 50 ksi |
| AFN6 | 0.5 Hf + 3.0 Ti + 0.2 Ga | 1754.4 |
| D219 | 0.5 Hf + 5.0 Ti + 0.2 Ga | 2376 |
| D218 | 0.5 Hf + 1 Ti + 0.2 Ga | 185.6 @ 40 ksi |
| AFS2 | 0.5 Hf + 1 Ti + 1 Ta | 60.3 |
| AFS16 | 0.5 Hf + 1 Ti + 1 Ta | 47.3 |

In the above Table II, the term "F.O.L." means "failed on loading" when the specimen was being tested. As can be seen from the data of Table II, there is a synergistic strength improvement effect in the combination of at least two of the elements Ga, Ti, Ta, and Hf, and particularly when all three of Ga, Ti, and Hf are present within the scope of the present invention, when compared to addition of a single of such elements. In connection with Ga, identified in U.S. Pat. No. 5,116,438 to improve low temperature ductility, it was added to the present invention for that purpose. However, it was discovered, unexpectedly, that Ga appeared to act to delay fracture initiation and, in effect, toughen the alloy. This was shown in the results of tensile testing presented in the following Table III. In addition, Ga benefits the stress rupture strength as can be seen in the above Table II, for example, by comparing alloy D113 including 7.5% Ti, which failed on loading, with alloy D216 including 7.5% Ti and 0.2% Ga, which has a stress rupture life for the conditions tested of about 1208 hours. Another preferred form of the present invention, in which all three elements Ga, Ti, and Hf are included and in the range comprising, in atomic %, about 45–59% Ni, about 0.02–0.5% Ga, about 0.25–10% Ti, about 0.2% to less than about 1% Hf, with the balance Al and incidental impurities, is represented by alloy D219 which had a stress rupture life of 2376 hours at 35 ksi and by alloy AFN 20 which had a stress rupture life of 1785 at the higher level of 50 ksi, in these tests conducted. Alloy D209 appears to show that about 1% Hf can embrittle the alloy as does a Ti level greater than about 10 % in Alloy D144. In the alloys in Table II, the nickel content, in atomic %, was 50% except for alloys D113, D114, and D144 which included 52% Ni, and except for alloy AFS2 which included 53% Ni.

TABLE III

Average Room Temperature Tensile Strength (for <110> oriented specimens)

| Alloy | Addition to NiAl (atomic percent) | Average Strength (ksi) |
|---|---|---|
| D5 | — | 29.9 |
| D128 | 0.05 Ga | 35.1 |
| D129 | 0.2 Ga | 47.5 |
| D117 | 0.5 Hf | 93.0 |
| D176 | 0.5 Hf + 0.05 Ga | 106.1 |
| D211 | 0.75 Hf | 22.3 |
| AFN2 | 0.75 Hf + 0.2 Ga | 87.1 |
| D113 | 7.5 Ti | 22.7 |
| D178 | 7.5 Ti + 0.2 Ga | 58.2 |
| D218 | 0.5 Hf + 1 Ti + 0.2 Ga | 107.0 |

In the above Table III, all substitutions were made at the expense of Al. All alloys included 50 at % Ni except for alloy D113 which included 52 at % Ni. In that table, alloy D5 represents the 50% Ni 50% Al intermetallic, and D128 and D129 are typical of alloys described in the above identified U.S. Pat. No. 5,116,438 in which Ga was added for improved room temperature ductility. Alloys D117, D211 and D113 show average tensile data for a single element addition; and alloys D176, AFN2, D178, and D218, within the scope of the present invention, show, in each example, the improved tensile strength resulting from the addition of at least two elements selected from Ga, Hf, and Ti.

A summary comparison of stress rupture properties of various combinations of elements, including that of the present invention, is shown in the graphical presentation of FIG. 1 wherein the well known Larson-Miller parameter is used. That parameter is based on the relationship $P=T(C+\log t)\times 10^{-3}$, where P is the time temperature parameter number, T is absolute temperature in degrees Rankine, t is time in hours, and C is the constant used. In this description, the data presented used C=20. It has been well established in the metallurgical art, that the Larson-Miller parameter number or graph of numbers can be used to compare directly the stress rupture strengths of various different alloys.

In FIG. 1, data for the NiAl intermetallic is included for comparison and information. Comparisons between the addition of a single element with the addition of that element and Ga results in a significant improvement in stress rupture properties. The addition of all three elements Hf, Ti, and Ga, within the scope of the preferred form of the present invention, provides a NiAl intermetallic alloy with outstanding stress rupture properties, even when compared with current nickel base superalloys developed for and tested in the form of a single crystal. Such a comparison is shown in the graphical presentations of FIGS. 2A and 2B, both including a plot of the Larson-Miller parameter to present a summary or average of a large amount of data for the types of alloys identified.

Figure 2A:
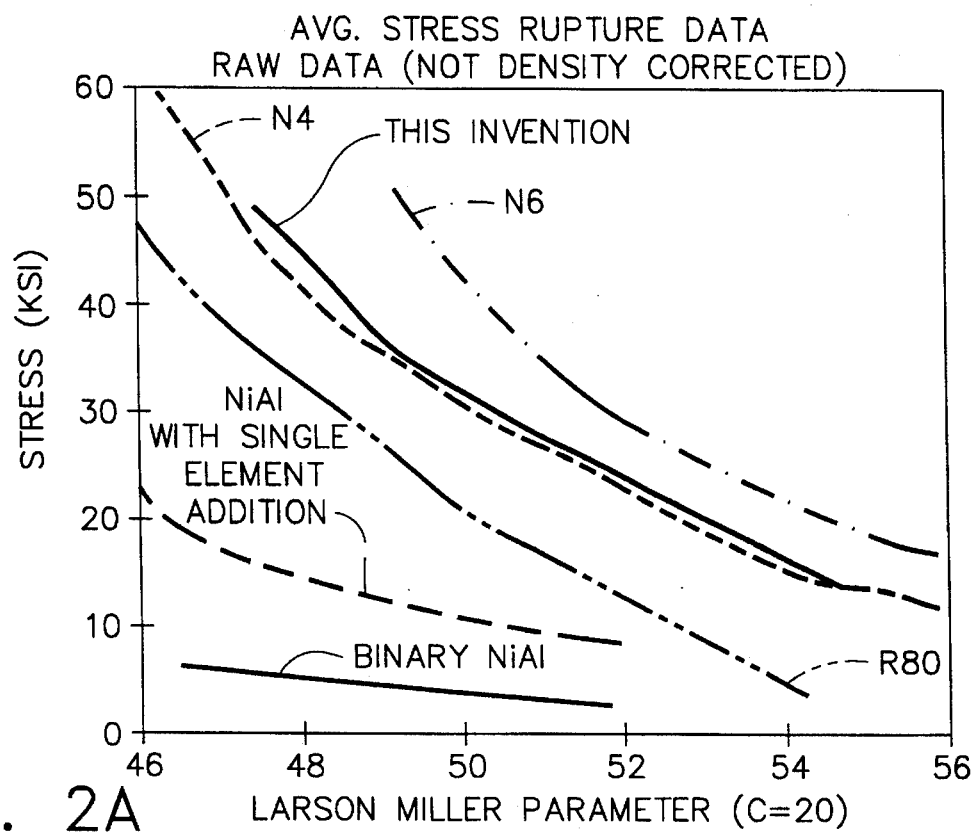
FIGS. 2A and 2B are graphical comparisons of stress rupture lives of the present invention with other forms of the NiAl system and with advanced single crystal nickel base superalloys using the Larson-Miller parameter.
Figure 2B:
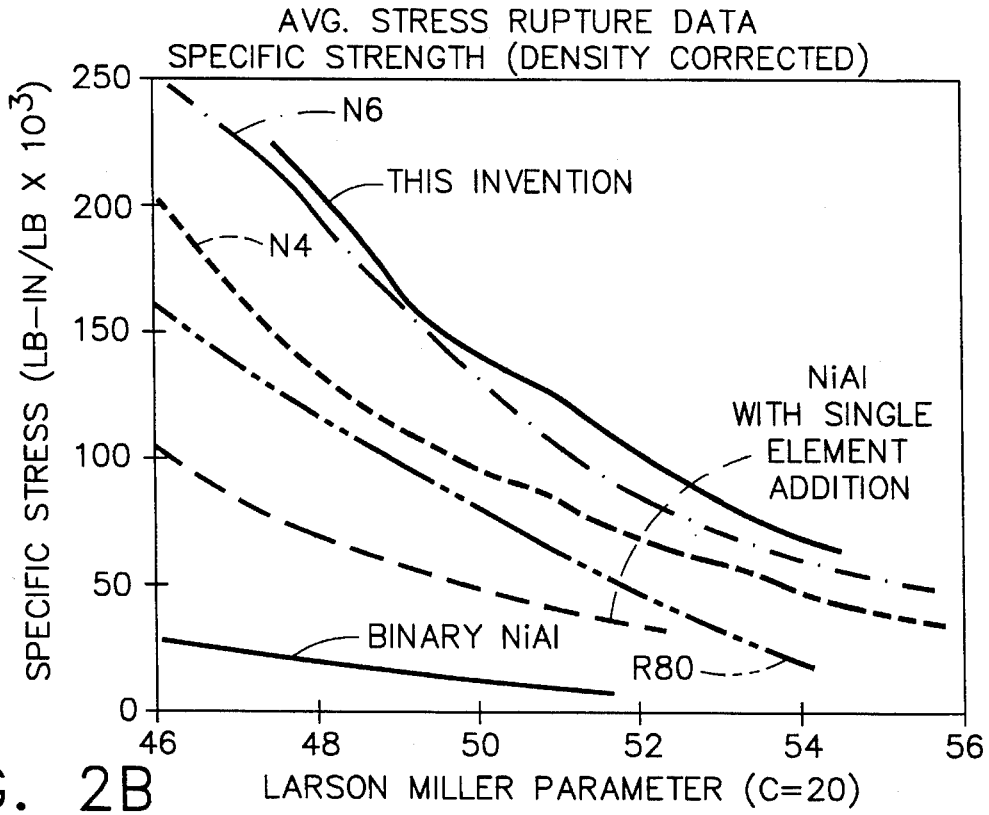

The data of FIG. 2A is not corrected for the lower density of the NiAl intermetallic alloys and includes stress in ksi as a measurement. The data of FIG. 2B is corrected for density, as a more realistic comparison, and uses specific stress in the units shown as a measurement. In FIGS. 2A and 2B, the term "this invention" refers to the specifically preferred form of the present invention represented by alloys D219 and AFN20, within the composition range identified above. As was mentioned above, the present invention can compare favorably with current nickel base superalloys in the form of single crystals. In FIGS. 2A and 2B, these are represented by data for nickel base single crystal superalloys identified and reported in the art as alloy René N4 and alloy René N6. Such alloys are described in U.S. Pat. Nos. 5,154,884 and 5,270,123. The composition ranges for these alloys, by weight, are included within about: 7–13% Co, 4–10% Cr, 1–2% Mo, 5–6% W, up to6% Re, 4–8% Ta, 4–7% Al, up to 4% Ti, 0.1–0.2% Hf, 0.01–0.1% C, 0.002–0.006% B, up to 0.02% Y, up to 0.5% Nb, with the balance Ni and incidental impurities. Also included in FIGS. 2A and 2B for information are data for the well known and commercially available nickel base superalloy René 80. As shown in FIG. 2A, the above specifically preferred form of the alloy of the present invention, represented by alloys D219 and AFN20, compares favorably with alloys N4 and N6 even when not density corrected. However, after correction for relative density, that specifically preferred alloy of the present invention shows outstanding stress rupture life, and its potential for use in the strenuous operating conditions found in the turbine section of an advanced gas turbine engine, for example as a single crystal airfoil portion of a gas turbine engine component.

Figure 3:
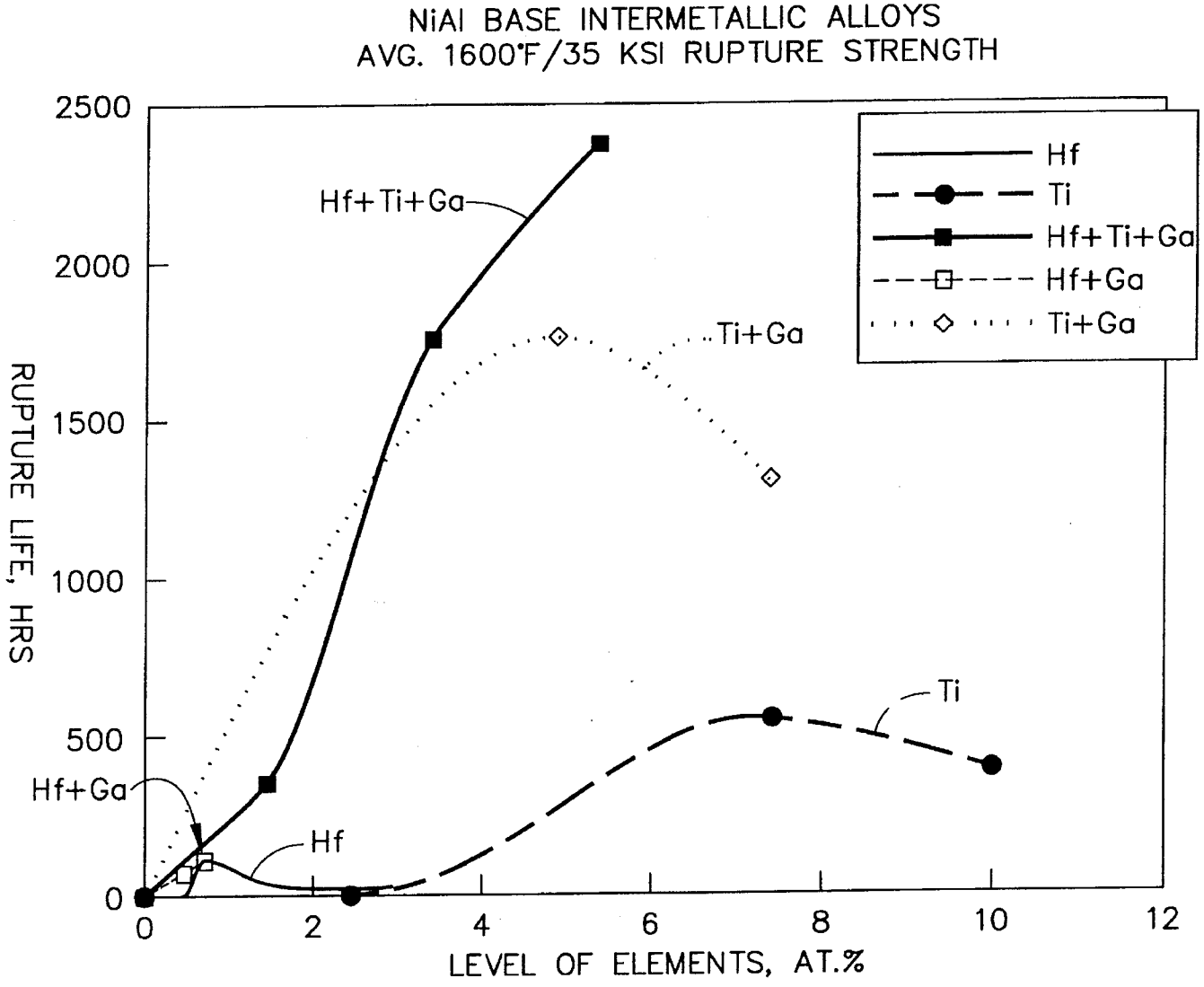
FIG. 3 is a graphical comparison of the average 1600° F. stress rupture strength at 35 ksi of various element combinations with the NiAl intermetallic system to form an intermetallic alloy.

Another summary and comparison of stress rupture data associated with evaluation of the present invention is shown in the graphical presentation of FIG. 3, presenting an average of 1600° F. stress rupture strength data at 35 ksi. Again it can be seen that the combination of at least two of the elements Hf, Ti, and Ga, and preferably all three, results in significantly improved life compared with a single element addition in the NiAl intermetallic system.

Micrographic studies of alloys evaluated in connection with the present invention have shown that there exists in the microstructure of the intermetallic alloys of the present invention, for example as represented by alloys D219 and AFN20, a beta matrix with at least one strengthening precipitate phase in the form of interconnected chains or discrete portions or both. Therefore, the present invention is characterized as having a microstructure including a beta matrix and at least one precipitate phase of a type which strengthens the alloy and an article made therefrom. Presently, it is believed that at least a portion of the precipitate phase is the β' phase, and may include other precipitate phases, such as one or more which can result from the presence of small amounts of Si, as has been discussed above. In any event, the precipitate phase or phases result from addition of the combination of elements in accordance with the present invention and significantly strengthens the NiAl intermetallic system to enable it to be competitive with current nickel base single crystal superalloys and articles made therefrom.

The present invention has been described in connection with specific examples and embodiments. However, it should be understood that these are presented as typical of rather than in any way limiting on the scope of the present invention. Those skilled in the metallurgical art will recognize that the present invention is capable of other variations and modifications within its scope as defined by the appended claims.

We claim:

1. A beta phase NiAl intermetallic alloy consisting essentially of, in atomic percent, about 45–59% Ni, about 0.1–10% of at least two elements selected from the group consisting of Ga, Hf, and Ti, up to 1% Zr, up to 5% Ta, up to 5% Nb, up to 5% V, with the balance Al and incidental impurities;

when selected the:

Ga being about 0.02–0.5%,

Hf being about 0.2 to less than about 1%, and,

Ti being about 0.1–10%, when included the:

Zr being about 0.1–1%,

Ta being about 0.1–5%,

Nb being about 0.1–5%, and,

V being about 0.1–5%;

the intermetallic alloy characterized by having, in combination,:

a) a microstructure consisting essentially of an NiAl beta matrix phase and at least one precipitate phase in the NiAl beta matrix, and b) an average stress rupture life of at least about 25 hours when tested at 1600° F. under a stress of about 35 ksi.

2. The alloy of claim 1 in which about 0.02–0.5% Ga and about 0.25 to less than 1% Hf are selected.

3. The alloy of claim 1 in which about 0.02–0.5% Ga and about 0.1–10% Ti are selected.

4. The alloy of claim 1 comprising, in atomic percent, about 45–59% Ni, about 0.02–0.5% Ga, about 0.25 to less than 1% Hf, about 0.1–10% Ti, with the balance Al and incidental impurities.

5. The alloy of claim 4 in which the Ga is about 0.05–0.2%, the Hf is about 0.25–0.8%, and the Ti is about 1–8%.

6. The alloy of claim 5 in which the Ga is about 0.05–0.2%, the Hf is about 0.5%, and the Ti is about 1–5%.

7. A beta phase intermetallic article having the composition, microstructure and properties of claim 1.

8. The article of claim 7 in the form of a single crystal.

9. The article of claim 8 in which the article is at least an airfoil portion of a gas turbine engine turbine component.

* * * * *